United States Patent [19]

Hepworth et al.

[11] Patent Number: 4,599,955

[45] Date of Patent: Jul. 15, 1986

[54] COAL SLAGGING BURNER FOR PRODUCING CLEAN LOW-SULFUR FUEL GAS

[75] Inventors: Malcolm T. Hepworth, Golden; Gordon R. Wicker, Lakewood, both of Colo.

[73] Assignee: AMAX Inc., Greenwich, Conn.

[21] Appl. No.: 777,860

[22] Filed: Sep. 18, 1985

Related U.S. Application Data

[63] Continuation of Ser. No. 664,269, Oct. 24, 1984, abandoned.

[51] Int. Cl.[4] ..... F23D 1/00

[52] U.S. Cl. ..... 110/347; 110/265; 110/266

[58] Field of Search ..... 110/347, 265, 266, 263, 110/264, 261

[56] References Cited

U.S. PATENT DOCUMENTS

| | | | |
|---|---|---|---|
| 2,745,732 | 5/1956 | Oster | 75/26 |
| 2,777,407 | 1/1957 | Schindler | 110/266 |
| 2,881,720 | 4/1959 | Lotz | 110/266 |
| 2,891,493 | 6/1959 | Gram, Jr. et al. | 110/266 |
| 2,957,436 | 10/1960 | Lotz | 110/265 |
| 2,971,480 | 2/1961 | Sage | 110/266 |
| 2,979,000 | 4/1961 | Sifrin et al. | 110/265 |
| 3,179,074 | 4/1965 | Clark et al. | 110/265 |
| 3,257,992 | 6/1966 | Bishop | 110/265 |
| 4,154,581 | 5/1979 | Nack et al. | 110/347 |
| 4,308,808 | 1/1982 | Brown | 110/347 |
| 4,312,280 | 1/1982 | Shearer et al. | 110/347 |
| 4,411,879 | 10/1983 | Ehrlich et al. | 110/347 |
| 4,474,010 | 10/1984 | Shibuya et al. | 110/347 |

*Primary Examiner*—Henry C. Yuen

*Attorney, Agent, or Firm*—Michael A. Ciomek; Eugene J. Kalil

[57] ABSTRACT

Sulfur-containing coal is combusted in a cyclone furnace under strongly reducing conditions with a sulfur fixing agent such as lime to produce a basic slag containing the ash and sulfur content of the coal and a product gas of high combustible content which may be burned as a fuel gas in a steam generator or otherwise to yield an exhaust gas which does not require scrubbing.

5 Claims, 1 Drawing Figure

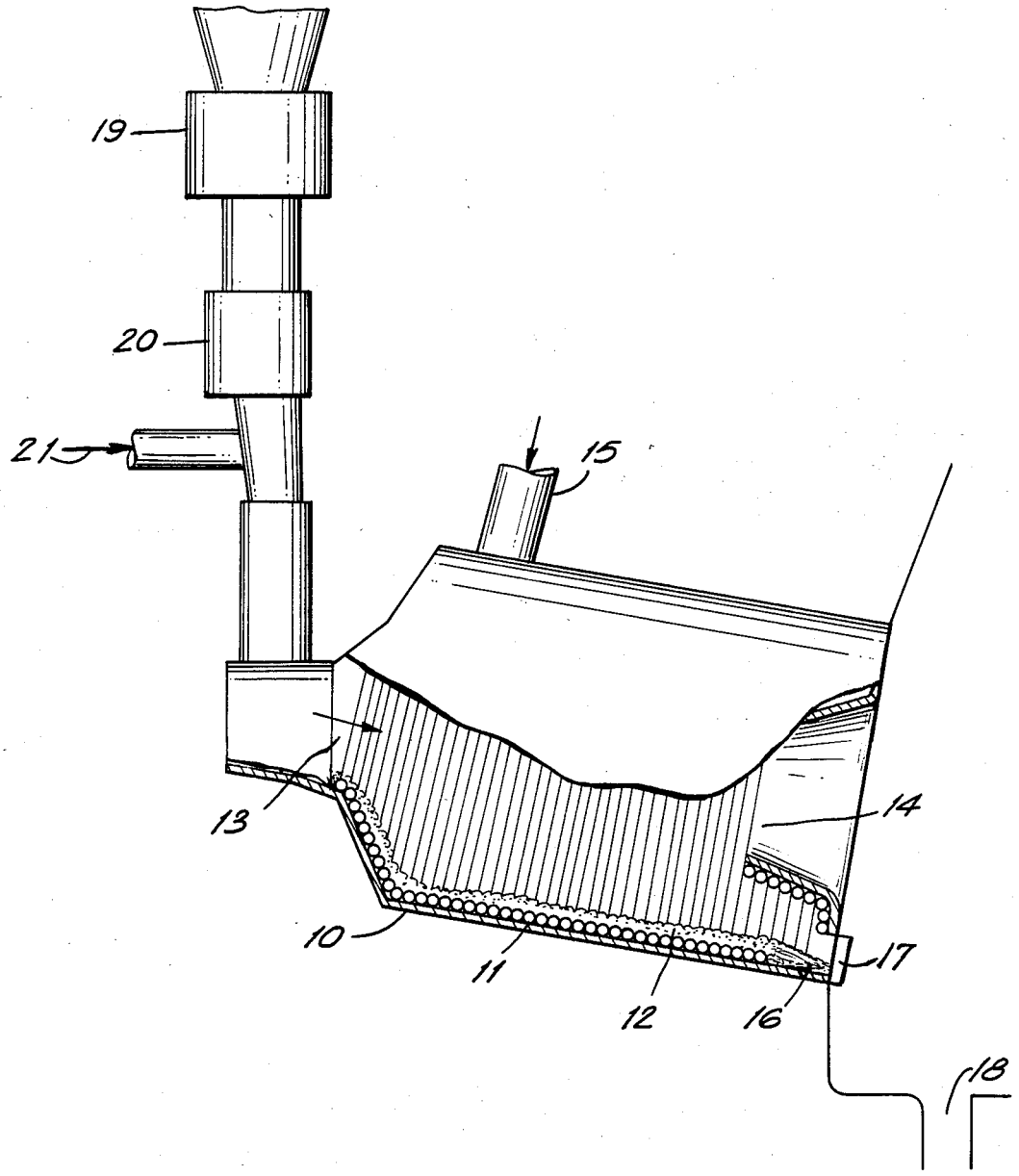
19
20
21
15
13
14
10
11
12
16
17
18

COAL SLAGGING BURNER FOR PRODUCING CLEAN LOW-SULFUR FUEL GAS

This application is a continuation of application Ser. No. 664,269 filed Oct. 24, 1984, now abandoned.

This invention is directed to a process for combusting sulfur-containing coal to produce a stack off-gas of greatly reduced sulfur dioxide content.

BACKGROUND OF THE INVENTION AND THE PRIOR ART

The burning of coal provides a major source of electric power in the United States. It has increasingly become apparent that coal-burning power plants are a major source of the pollutants, including $SO_2$ and $NO_x$, which are responsible for damage to fish and plant life in the northeastern part of the country and in Canada due to the phenomenon now known as "acid rain". The acid rain problem is complex and the steps necessary to control the problem are not easy to accomplish. For example, coal is the most abundant source of fossil fuel and will be available long after the earth's available petroleum supply is exhausted. Unfortunately, most of the coal supplies in the Eastern and Midwestern United States are high in sulfur, and substitution of lower-sulfur Western coals therefore is not only expensive because of transportation cost but can cause further distress in the already economically deprived coal-mining areas.

It is accordingly desirable that economic means be found whereby available high-sulfur coals could be utilized without further contributing to the atmospheric pollution problem.

It is known also that numerous types of coal-burning apparatus are available for large-scale coal combustion for purposes such as steam generation. Thus, the cyclone burner was developed in the 1940's particularly for the purpose of burning an Illinois coal which has a high ash content and a low ash-fusion temperature. A paper entitled "Operating Experiences With Cyclone-Fired Steam Generators" by V. L. Stone and I. L. Wade which appeared in *Mechanical Engineering*, Vol. 74, 1952 at pages 359 to 368 describes operation of a power plant using cyclone burners. The book *Low-Rank Coal Technology; Lignite and Subbituminous* by Gronhovd and Sondreal of the Grand Forks Energy Technology Center and Kotowski and Wiltsee of the Energy Resources Company, Inc. published by the Noyes Data Corporation in 1982 provides further information. Gronhovd et al. point out that the cyclone furnace promotes complete combustion of coal in a high temperature, turbulent slagging environment and is applicable to all ranks of coal. Cyclone firing is considered to reduce the fly ash content of the flue gas. Heat release rates are extremely high, hence local temperatures are high and are sufficient to fuse the ash from most coals on the refractory walls of the cyclone.

Gronhovd et al. point out that the cyclone furnace is a water-cooled, refractory-lined cylinder. Crushed or pulverized coal and primary air are fed at the burner end of the furnace and secondary air is fed into the cylinder tangentially, thus creating a whirling or cyclonic motion to gases within the cylinder. Coal particles are entrained in the high velocity stream and thrown against the furnace wall by centrifugal force where they are held in the molten slag layer. The high-velocity tangential stream of secondary air supplies combustion oxygen to the coal particles. Molten slag drains to the bottom of the furnace from which it is removed. The cyclone furnace is thus a slagging type of coal burner.

Reference may also be made to U.S. Pat. No. 2,745,732 which describes use of a cyclone type furnace under strongly reducing conditions to burn coal and to reduce and/or melt iron ores fed into the furnace.

Proposals have been known, as for example, U.S. Pat. No. 4,095,960 for gasifying high sulfur coal in a fluid bed or the like in the presence of lime (CaO) to fix sulfur as CaS.

BRIEF SUMMARY OF THE INVENTION

Finely divided high-sulfur coal and a basic ingredient such as powdered lime, limestone or dolomite are combusted in a cyclone type furnace under conditions of incomplete combustion to generate a combustion-product gas high in combustibles and to fix the sulfur content of the coal with the basic ingredient in the slag generated within the furnace. The combustion-product gas low in sulfur may be burned in a steam generator or otherwise and the slag bearing the sulfur originally supplied in the coal is removed from the furnace.

DESCRIPTION OF THE DRAWING

The FIGURE of drawing illustrates the cyclone furnace utilized in accordance with the invention.

DETAILED DESCRIPTION OF THE INVENTION

The invention is best described in relation to the drawing which illustrates a horizontal cyclone furnace in partial section. Reference character 10 depicts the steel furnace shell which is protected on the interior surfaces with steel tubes 11 adapted to carry cooling water. Refractory lining 12 is provided over tubes 11. Opening 13 at the inlet end provides means for feeding powdered coal and primary air. Reentrant opening 14 enables exit of combustion-product gas while inhibiting loss of ash or slag. Reference character 15 depicts an inlet for admitting secondary air tangentially under substantial pressure. A sump 16 is provided for collecting molten slag. Molten slag exits the furnace through tap hole 17 which leads to a slag tank indicated at 18. In operation, coal from bunker (not shown) which has been crushed and/or pulverized to −4 mesh or finer is weighed continuously in coal scale 19 and fed through coal feeder 20. Primary air is introduced at 21 and the mixture of primary air and crushed coal is then fed through opening 13 into the cyclone furnace.

It is to be appreciated that conditions within the furnace are highly turbulent and that high gas velocities are generated.

In order to generate the strongly reducing atmosphere within the furnace which is contemplated in accordance with the invention, the furnace is fired with much less oxygen than the amount required for complete combustion of the coal. Initially, in order to elevate the temperature within the furnace to at least 1200° C., e.g., a temperature in the range of about 1300° to about 1500° C., it is expedient to completely combust the coal feed so as to rapidly heat the burner cavity and coat the interior walls with molten slag.

Operation of the furnace in accordance with the invention once the furnace is at operating temperature then requires reducing the ratio of total oxygen supplied thereto to the weight of coal to be consumed. The reduced oxygen supply results in an increased amount of uncombusted carbon from the coal and this carbon, in the form of fine particles, is largely caught in the slag coating on the furnace walls. Oxidizing constituents in the atmosphere contacting the molten slag, e.g., carbon dioxide and water vapor, react with the hot carbon particles to form carbon monoxide and hydrogen in the manner known in the production of water gas. Important reactions in the process include $$C+CO_2 \rightleftharpoons 2CO \quad (1)$$

$$CO_2+H_2 \rightleftharpoons H_2O+CO \quad (2)$$

$$CaO+H_2S \rightleftharpoons CaS+H_2O \quad (3)$$

and a combination of (2) and (3):

$$H_2+CaS+CO_2 \rightleftharpoons CaO+H_2S+CO \quad (4)$$

The first reaction cannot be in equilibrium since there has to be a sufficiently high $CO_2$ concentration relative to CO in order to cause the disappearance of carbon by combustion. In other words, carbon is not an equilibrium phase. The second reaction is an equilibrium between the four gas species CO, $H_2O$, $H_2$ and $CO_2$ and is commonly called the water-gas shift reaction. This equilibrium constant is well-established and lies in the range between 1.5 and 4 in the temperature range between 1000° and 1500° C. The combined equilibrium constant (represented by the fourth equation with the gas species $H_2$, $CO_2$, $H_2S$ and CO over the solid phases of CaS and CaO) controls the limiting levels of hydrogen sulfide which can be achieved. This equilibrium constant, namely:

$$\frac{PH_2S.PCO}{PH_2.PCO_2},$$

is in the range 0.01 to 0.08 in the temperature range of 1000° to 1500° C. Consequently, in order to achieve very low levels of $H_2S$ in the gas phase (of the order of 500 ppm), depending upon the hydrogen content of the coal, the ratio of CO to $CO_2$ must be at least 10 to 1 in order to satisfy this equilibrium.

Under these strongly reducing conditions, the gas phase is essentially composed of nitrogen, hydrogen and carbon monoxide with small amounts of carbon dioxide and water vapor. Any iron present in the coal is reduced to the elemental form and has its melting point reduced by the presence of some carbon in solution. A highly fluid system of a liquid metal phase along with a refractory calcium sulfide phase is thus created.

If air is employed as the oxygen source, the nitrogen thereby introduced dilutes the product gas to such an extent that the product gas will contain about 65% or more nitrogen. Furthermore, firing the furnace under conditions of restricted oxygen supply results in decreased output of heat as compared to the situation which would exist if the same amount of coal were completely combusted to yield carbon dioxide. However, minimum temperature conditions must still be maintained within the furnace so as to melt the slag which results from the reaction of the coal ash and the basic ingredient introduced into the furnace and to maintain the slag in a fluid condition.

The multiple and, to an extent, contradictory requirements which must be met require careful control in order to accomplish the objectives of the invention. These requirements and the means for meeting them are as follows:

1. The temperature requirement.

Temperature conditions become more controllable through the use of highly preheated combustion air. Combustion air preheat temperatures of at least about 300° C. up to about 600° C. or higher are of benefit. Use of oxygen-enriched air or even pure oxygen, which may also be preheated, is highly beneficial in a number of ways. Thus, there is no need to preheat essentially useless diluent nitrogen initially and loss of sensible heat to the nitrogen in the off-gas is avoided. Furthermore, higher flame temperatures are achieved. Introduction of moisture from any source, e.g., combustion air, coal, etc. is a burden on the temperature requirement. Advantageously, combustion air is dried before preheating.

2. The nature of the coal being burned.

Those skilled in the art are aware that coals are diverse in nature, varying widely in terms of heat value, volatiles content, ash content, ash composition, crushability, ash softening point, moisture content, sulfur content, etc. The following table illustrates the variability of the ash composition of coals:

| | | | Variations In Coal Ash Compositions With Rank In Percent | | | | | | | |
|---|---|---|---|---|---|---|---|---|---|---|
| Rank | $SiO_2$ | $Al_2O_3$ | $Fe_2O_3$ | $TiO_2$ | CaO | MgO | $Na_2O$ | $K_2O$ | $SO_3$ | $P_2O_5$ |
| Anthracite | 48–68 | 25–44 | 2–10 | 1.0–2 | 0.2–4 | 0.2–1 | — | — | 0.1–1 | — |
| Bituminous | 7–68 | 4–39 | 2–44 | 0.5–4 | 0.7–36 | 0.1–4 | 0.2–3 | 0.2–4 | 0.1–32 | — |
| Subbituminous | 17–58 | 4–35 | 3–19 | 0.6–2 | 2.2–52 | 0.5–8 | — | — | 3.0–16 | — |
| Lignite | 6–40 | 4–26 | 1–34 | 0.0–0.8 | 12.4–52 | 2.8–14 | 0.2–28 | 0.1–1.3 | 8.3–32 | — |
| Utah bituminous | 43–48 | 16–19 | 3.8–4.2 | 0.0–1.0 | 6.5–8.1 | 0.9–1.1 | 4.3–4.9 | 0.4–0.7 | 3.5–4.1 | <1.0 |

Desirably, coals treated in accordance with the invention will contain 15% or more volatile matter, but not more than 20% moisture. Advantageously, the moisture content of the coal is low. Sulfur content of coals treated will usually be at least about 2% and up to about 8%, by weight, with a preferred range for sulfur being about 3% to about 5% or 6%, by weight. Coals of any rank can be used.

The crucial point is that moisture (secondarily) and hydrogen (primarily) associated with low rank coal affect the desulfurizing power by virtue of equilibrium (4). Also basic slags are desired in order to drive equilibrium (4) to the left. Sufficient lime must be added to react with the acid and amphoteric constituents in order to provide a sufficient excess to promote back reaction (4).

Coals which range from a practical minimum of 3 percent to a practical maximum of 6 percent sulfur, will have about half of this sulfur associated with iron. Therefore an iron level of approximately 4 percent could be expected. Depending upon the reduction potential, iron will either be reduced to metallic iron (and leave the slag system) or be present as FeO to react with silica to form fayalite with an included refractory calcium sulfide phase. Components which contribute to breaking up the slag network such as soda or potash will have a pronounced effect on slag fluidity. The ash content of the coal is not too important so long as it acts as a sink for calcium sulfide. High ash coals are not undesirable. The heat content of the coal should be at least sufficient to achieve a combustion temperature in the range 1200° to 1500° C. with a $CO/CO_2$ ratio of more than 10/1.

Regarding the rank of the coal, as was mentioned previously, hydrogen plays a negative role in the degree of desulfurization attainable (equilibrium 4).

3. Control of slag composition.

As can be seen from the table of ash compositions, the principal constituent of most coal ashes is silica, $SiO_2$. The basic ingredient fed to the furnace for sulfur-control purposes will report to the slag. The basic ingredient preferably is lime, CaO, since use of this compound will minimize the heat requirement associated with this required function. The $CaO:SiO_2$ ratio in the slag preferably is maintained in the range of about 2:1 to 1.5:1 to provide a slag which has the necessary fluidity at temperatures of 1200° C. and higher and which will have high solubility for sulfur-containing compounds such as calcium sulfide (CaS).

4. Control of the desulfurization reaction.

The sulfur content of the coal will initially, for the most part, be converted rapidly to hydrogen sulfide in the turbulent interior of the cyclone furnace where conditions are far from equilibrium. The powdered lime, which is introduced into the furnace at a controlled rate related to the sulfur content of the coal rapidly reaches incandescence in the furnace atmosphere and reacts quickly with $H_2S$ in the gas to form a sulfide compound which is deposited into the slag coating on the furnace wall. It can be considered that the slag coating follows a helical path about the cylindrical face of the furnace until it finally arrives at the slag tap hole. Contact between the furnace gases and the slag continues with vigorous disturbance of the gas-slag interface so that further opportunity is afforded for reaction between sulfur compounds in the gases and lime in the slag. Since the desulfurization reactions proceed at high rates under non-equilibrium conditions, a substantial excess of lime over sulfur, e.g., at least a 20% excess over the stoichiometric quantity, is provided. Thus, the combinations of reactions in the turbulent gas phase and in the highly disturbed slag-gas interface enables substantial desulfurization of the gas by the time it exits the cyclone furnace.

It will be appreciated that the basic ingredient, e.g., lime, can be mixed with the coal, can be introduced with the primary air or can be introduced with the secondary air. Rate of lime feed is carefully controlled since the lime not only contributes desulfurization but also affects fluidity of the slag.

Product gas produced in the process will generally contain less than about 0.05% sulfur, by volume, and may contain about 20% to about 30% CO and about 10% to about 30% $H_2$ by volume. Even higher combustible gas content is achievable with oxygen firing. The product gas may then be burned in an afterburner to generate steam in a conventional type of steam generator, in which case the sensible heat content of the product gas is also utilized. Alternatively, the sensible heat can be used for preheating combustion air, in a waste heat boiler or otherwise and the product gas can be utilized as fuel in applications such as enamel kilns, etc. The sulfur content of exhaust gas from combustion of the product gas is so low that no scrubbing of the exhaust is required. An advantage of burning coal in stages, so that solid coal is first gasified to CO and $H_2$ with removal of sulfur, is that nitrogen oxides are not produced.

An example will now be given:

A cyclone furnace as illustrated in the drawing having a diameter of 8 feet and a length of 11 feet is brought up to an operating temperature of about 1350° C. by firing with natural gas and a theoretical quantity of primary and secondary air for complete combustion. Firing is then adjusted to produce a strong reducing atmosphere and crushed slag from a previous run is fed through the primary air-coal feed to form a slag coating of molten fluid slag and firing with a fine pulverized Illinois coal is commenced using nearly stoichiometric air supply preheated to 400° C. to produce a $CO/CO_2$ ratio of 20/1 and an $H_2/H_2O$ ratio of 7/1. The coal has a moisture content of 12.1% and a proximate analysis, dry basis, of 40.2% volatiles, a fixed carbon content of 39.1%, an ash content of 8.6% and a sulfur content of 4.3% (on a moisture and ash-free basis). Heating value of the coal is 11,500 BTU/pound. Fine CaO in excess of stoichiometric requirements is fed through the secondary air inlet. Coal is fed at a rate of 100,000 pounds per hour and oxygen-enriched air is fed at a rate of 5.4 million standard cubic feet per hour. Under steady state operation product gas containing, by volume, about 27% CO, 11% hydrogen, 2% $H_2O$, 1% $CO_2$, balance nitrogen is obtained. Sulfur content of the gas is less than 0.05% and it is combusted with air in a steam generator.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. The process for combusting coal containing about 2% to 8% sulfur by weight to release and recover the heat content thereof while producing a low-sulfur off-gas which comprises:

combusting finely divided coal in a slagging cyclone burner under conditions of incomplete combustion to convert the sulfur content of said coal to hydrogen sulfide, carrying out said incomplete combustion within the interior wall of said burner in the presence of a basic compound selected from the group consisting of lime, limestone and dolomite premixed in powdered form with said coal in an amount proportioned to the silica content of said coal to produce a fluid slag in said burner and producing a combustion-product gas rich in combustibles but of reduced sulfur content, introducing said coal and the basic compound axially into said burner with primary air, while introducing preheated secondary air tangentially into said burner to maintain a combustion temperture of at least about 1200° C. in said burner, the interior wall of said burner being coated with said fluid slag which reacts with the sulfur compounds in the gas phase, the slag also containing carbon particles from the incomplete combustion of said coal which react with oxidizing constituents in the combustion-product gas, completely combusting the combustion-product gas and removing said molten slag containing most of the sulfur initially present in said coal.

2. The process of claim 1, wherein the secondary air is preheated to a temperature of at least about 400° C.

3. The process of claim 1, wherein the secondary air is oxygen enriched.

4. The process of claim 1, wherein the fluid slag is drained from said burner at a controlled rate.

5. The process of claim 1, wherein the gas generated in said burner contains, by volume, about 20% to about 30% CO, about 10% to about 35% hydrogen, up to about 5% $CO_2$ and up to about 5% $H_2O$, and less than about 0.05% sulfur.

* * * * *